United States Patent [19]

DeWalch

[11] Patent Number: 4,685,317

[45] Date of Patent: Aug. 11, 1987

[54] FRANGIBLE SEAL

[76] Inventor: Norman B. DeWalch, 1213 West Loop North, Suite 180, Houston, Tex. 77055

[21] Appl. No.: 909,751

[22] Filed: Sep. 19, 1986

[51] Int. Cl.[4] ..... E05B 39/02

[52] U.S. Cl. ..... 70/440; 70/50; 70/422; 292/307 R

[58] Field of Search ..... 70/50, 422, 439, 440; 292/307 R, 318

[56] References Cited

U.S. PATENT DOCUMENTS

| | | | |
|---|---|---|---|
| 2,319,753 | 5/1943 | Smith | 70/50 |
| 3,209,569 | 10/1965 | Bryson | 70/440 |
| 3,975,040 | 8/1976 | VanGompel | 292/318 |
| 4,424,694 | 1/1984 | Mochida | 70/422 |
| 4,454,736 | 6/1984 | Mochida | 70/422 |

FOREIGN PATENT DOCUMENTS

| | | | |
|---|---|---|---|
| 1570188 | 6/1980 | United Kingdom | 70/422 |
| 370331 | 4/1973 | U.S.S.R. | 70/440 |

*Primary Examiner*—Robert L. Wolfe

*Attorney, Agent, or Firm*—Paul L. DeVerter, II

[57] ABSTRACT

A frangible seal is provided for use with cylindrical access and key holes. The seal is made of a tearable and pliable material, and includes teeth and a score line. The teeth hold the seal in the key hole until the seal is destroyed and removed by unraveling it along the score line.

7 Claims, 7 Drawing Figures

FRANGIBLE SEAL

BACKGROUND OF THE INVENTION

This invention relates to a seal, and more particularly to a frangible seal which may be used to provide visual evidence of tampering with locks or access to adjustment points which are reached through a hole.

In the past, frangible seals, particularly for the utility industry, have consisted of a metal wire, which passes through access points, and ends of which are joined with a piece of lead. More recently, plastic counterparts have been developed in involve ends which may be inserted into a plastic enclosure with some ease, but which may not be backed out of the same enclosure. This invention is particularly suited for use with locks which have a rather large opening with a series of elements of a different diameters, such as are shown in the patents to Seiffert, U.S. Pat. No. 2,301,755; Roberts, U.S. Pat. No. 3,668,909; Uyeda, U.S. Pat. No. 4,418,555; and DeWalch, British patent application Ser. No. 2,173,544.

SUMMARY

In the utility industry, it is particularly desirable to utilize a seal, in addition to a lock, in order to give additional security to the integrity of the meter. The seal gives instant notice that the lock has been tampered with, or even removed, if such is the case. To perform this task, the seal must be constructed so that if it is removed to gain access to the lock, the seal cannot be reconstructed without it being apparent that the seal has previously been removed. Similarly, if it is desired to seal the opening to an adjustment screw in a carburetor, or to an electronic device, then the seal must be capable of simple insertion, and complete removal, as well as being impossible of reapplication without it being apparent that removal was once effected.

Thus, it is an object of the present invention to provide a frangible seal of relatively simple construction and which is easily inserted, and which at the same time may be easily removed, and not reinserted. Further, it is desirable that the seal be made of a material which will withstand wide variances of temperature and moisture, such as are encountered by utility meters. It is also desirable that such a seal help prevent the entrance of insects, particularly with locks having rather large cylindrical key holes.

The present invention is designed to meet these criteria.

Generally, the present invention provides a tubular body which is closed at its outer end. Along the exterior of the body are deformable teeth which engage projections or similar teeth within the lock. The tubular body also incorporates a score line which begins just beyond the closed end, and extends to the open end, to provide a tear line. Thus, when the closed end is grasped and pulled, the tubular body comes apart along the score line, thereby unwinding the seal as it is removed from the lock, and at the same time destroying the seal, so that it cannot be inserted without it being readily apparent that it has once been broken.

Other and further objects, features and advantages will be apparent from the following description of the presently preferred embodiments of the invention, given for the purpose of disclosure, when taken in conjunction with the following drawings:

BRIEF DESCRIPTION OF THE DRAWINGS

Like character references designate like parts throughout the several views of the drawings, which are.

DESCRIPTION OF THE PREFERRED EMBODIMENTS

Figure 1:
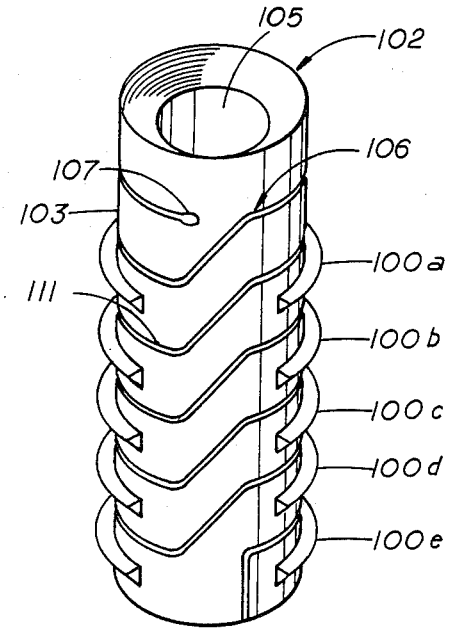
FIG. 1 is a general view of the frangible seal looking somewhat downwardly on the outer end.

Referring now to the drawings, and particularly to FIG. 1, the reference number 102 generally designates the frangible seal of the present invention, here shown as a plastic tubular structure. The presently preferred material is polyethylene which is tough, yet will tear along a score line, and is pliable or deformable. Extending outwardly from the body 103 of the seal are a series of teeth 100*a–e*. In this embodiment the teeth are interrupted, i.e., they do not go completely around the body 103, and are instead shown in two separate portions with a gap on either side. Further, each of the rows of teeth are parallel to each other. As can be seen, the teeth generally have a triangular cross-section with a radially extending flat portion at the upper end, and a tapered portion toward the open end of the body 103. The upper end of the body 103 is here shown as closed with a top 105 (better seen in FIG. 3).

Also in FIG. 1 is the score line 111 which extends from a small hole 107 near the top 105 around the body and between the teeth, in a generally helical fashion until it reaches the open end of the body 103. Although denominated a hole 107, actually a stress concentration point is all that is needed, and this may simply be a more greatly weakened portion of the score line 111 to ensure that when the top 105 is pulled, the body will begin to break apart at the hole and unravel, as will be hereinafter described.

Figure 2:
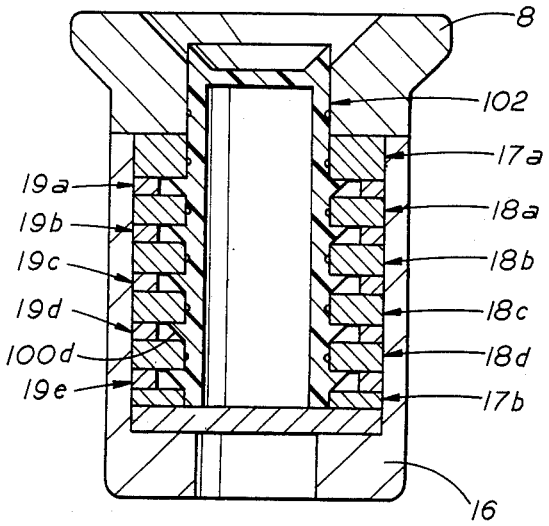
FIG. 2 is a partial sectional view showing the seal inserted into a cylindrical lock.

Referring now to FIG. 2, the tearable and pliable seal 102 is shown inserted into a cylindrical lock, such as shown in the British Patent Application previously noted. This lock includes a series of tumblers 17*a*, 17*b*, 18*a–d* with intermediate spacers 19*a–e*. The seal is inserted by pushing against the top 105 so that the open end goes into the cylindrical key hole of the lock 18. Because the seal is pliable, the teeth 100 will be deformed and push inwardly on the pliable body so that it may be forced into the key hole.

Figure 3:
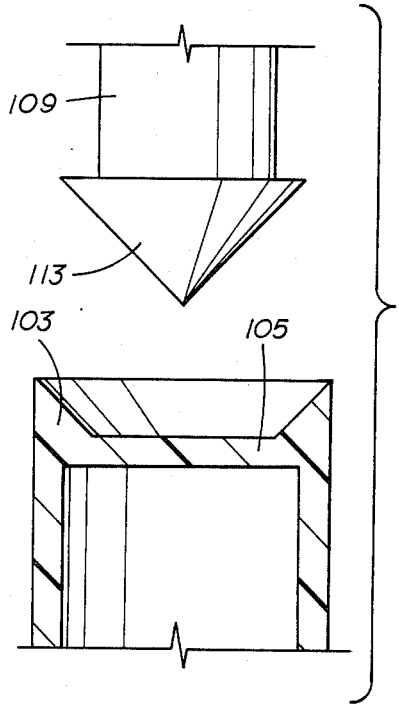
FIG. 3 is a partial sectional view showing the outer end of the seal and the extraction tool.
Figure 4:
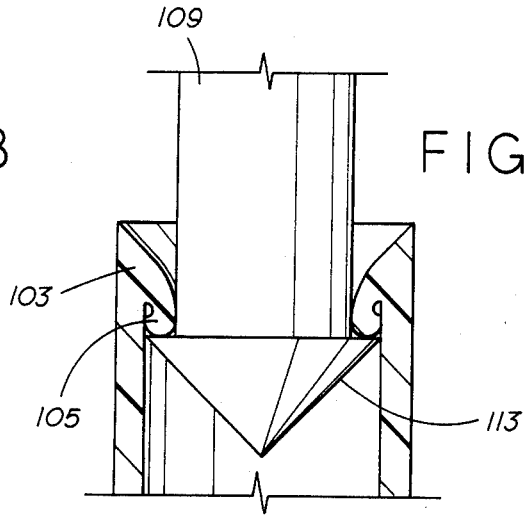
FIG. 4 is a view similar to FIG. 3 showing the extraction tool inserted through the outer end of the seal.
Figure 5:
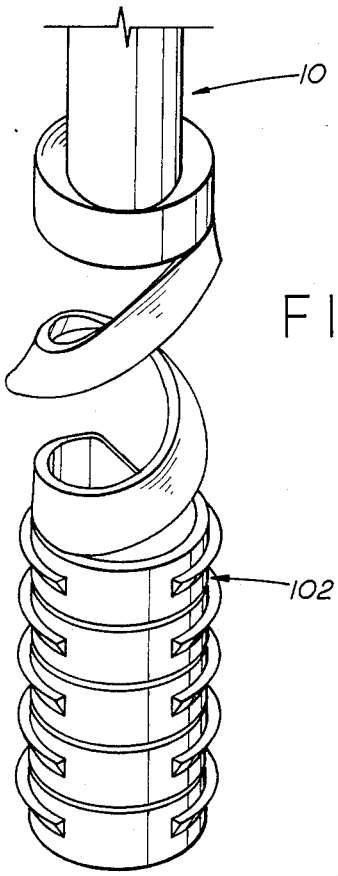
FIG. 5 is a general view, similar to FIG. 1, showing the extraction tool removing the seal and the seal tearing along the score line.

To remove the seal, and referring now to FIGS. 3, 4, and 5, an extraction tool 109 is utilized. The extraction tool is here shown as a cylindrical object resembling a spear having a conical point or dart 113 at the end. The outer edge of the dart is somewhat larger than the body of the tool 109. In use, the extraction tool is pushed into the top 105 of the body 103, which is relatively thin.

The tool punctures the top 105 and thus moves inside the tubular body, as seen in FIG. 4. Because the top 105 is thicker toward the outside of the body 103, than in its center, the thin region snaps under the pierced section. When the extraction tool 109 is pulled outwardly, the back edge of the dart grips and hooks to the top 105, and pulls outwardly upon it.

Referring now to FIG. 5, this causes the body 103 to shear, starting at the hole 107, along the score line 111 thus unraveling the body and allowing it to be removed from the lock. Note that the unraveling occurs level by level, thereby allowing each tooth to be pulled from under its tumbler, and the seal is completely removed from the lock. After removal, of course, the seal cannot be reinserted without it being apparent that it is unraveled, and that the top has been punctured. Thus, the seal is destroyed, and has served its purpose.

Figure 6:
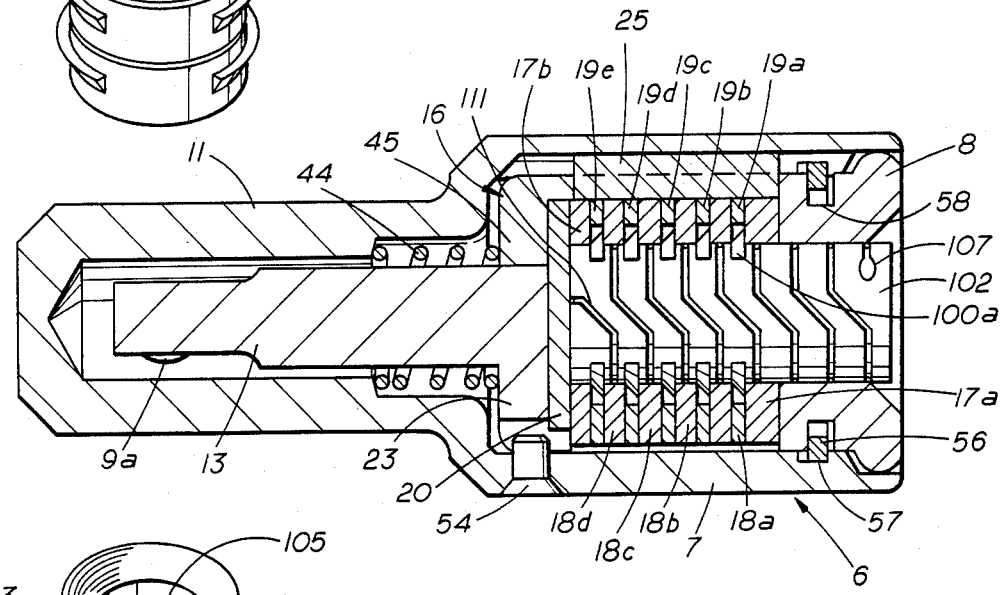
FIG. 6 is a partial sectional view, similar to FIG. 2, showing the relationship of the teeth and the tear line when inserted in a lock.

As seen in FIG. 6, the tear line 111 is situated between the teeth 100 and extends to the bottom of the seal 102. The interruptions in the teeth help ensure that the body can be removed as it is unraveled, which is particularly useful for locks which have cylindrical tumblers.

Figure 7:
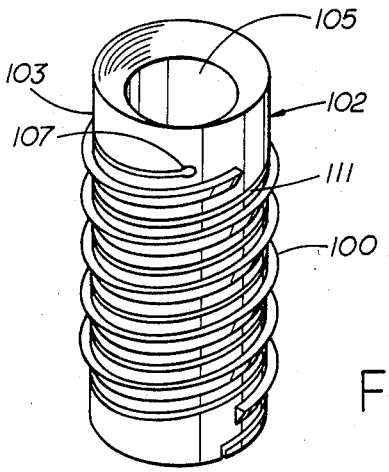
FIG. 7 is a view, similar to FIG. 1, showing a further embodiment of the invention.

However, it is contemplated that the present seal may also be used in holes which have a helical thread therein, such as for ajustment screws. Referring now to FIG. 7, in this instance the tooth 100 is helically positioned on the body 103. The score line 111, which starts at the hole 107, also extends in a helix between the teeth from the hole 107 to the bottom. It is also possible that the lock, or the hole to be sealed, may have a configuration which is polygolonal or even half round, rather than being circular. The present invention may be readily adapted for all such other cylindrical shapes, the essential elements being a body, teeth, and a score line with a stress concentration point near the top. It is also desirable that the top, or outer end, cover the outer end so that tampering with the seal will be visually evident.

The present invention, therefore, is well adapted to carry out the objects and attain the ends and advantages mentioned, as well as others inherent therein. While the presently preferred embodiments of the invention had been given for the purpose of disclosure, numerous changes in the details of construction, and the combination, shape, size, and arrangement of parts and uses may be resorted to without departing from the spirit and scope of the invention.

What is claimed is:

1. A frangible seal for use in a generally cylindrical hole having internal protrusions therein including:

A. a tubular body have a lower end and an upper end,

B. at least one tooth extending from the outer surface of the body,

C. the tooth being tapered from the body on the lower end side of the tooth to a greater distance from the body on the upper end side of the tooth, D. a tear starting hole in the body above the tooth and near the upper end of the body, E. a score line extending from the hole, about the body to the lower end, and F. the body being made of a tearable and pliable material whereby when the seal is inserted into a cylindrical hole it is held there by the tooth engaging the protrusions, and is removed when the upper end is grasped and pulled, a tear starting at the hole and the body of the seal unravelling along the score line as it is removed from the cylindrical hole.

2. The invention of claim 1 including a closed puncturable cap at the upper end.

3. The invention of claim 2 wherein the cap is thicker adjacent the body than in its center.

4. The invention of claim 1 wherein:

the tooth includes a series of teeth set in parallel about the body.

5. The invention of claim 4 wherein:

the teeth are interrupted.

6. The invention of claim 1 wherein:

the tooth is helical and extends from near the upper end to the lower end of the body.

7. An extractor tool for use with the frangible seal of claim 3, including:

a cylindrical spear, a generally conical point on the end of the spear, the base of the cone being larger than the body of the spear, but being slightly smaller than the inside of the tubular body, whereby insertion of the tool into the seal punctures the cap, and pulling upon the inserted tool causes the cone to grasp the cap of the seal, and the seal to unravel along the score line.

* * * * *